US009016555B2

(12) United States Patent
Plunkett et al.

(10) Patent No.: US 9,016,555 B2
(45) Date of Patent: Apr. 28, 2015

(54) FLEXIBLE LINER AND BAG-IN-BOX CONTAINER SYSTEMS

(75) Inventors: James Plunkett, Wareham, MA (US); Joseph J. Sullivan, Plymouth, MA (US)

(73) Assignee: CDF Corporation, Plymouth, MA (US)

( * ) Notice: Subject to any disclaimer, the term of this patent is extended or adjusted under 35 U.S.C. 154(b) by 246 days.

(21) Appl. No.: 12/061,331

(22) Filed: Apr. 2, 2008

(65) Prior Publication Data

US 2008/0245848 A1 Oct. 9, 2008

Related U.S. Application Data

(60) Provisional application No. 60/909,759, filed on Apr. 3, 2007.

(51) Int. Cl.
*B65D 5/56* (2006.01)
*B65D 6/16* (2006.01)
*B65D 77/06* (2006.01)

(52) U.S. Cl.
CPC ..... *B65D 77/062* (2013.01); *B65D 77/065* (2013.01)

(58) Field of Classification Search
CPC .... B65D 77/065; B65D 5/606; B65D 77/061; B65D 77/06; B65D 77/062; B65D 5/603
USPC ..... 229/117.3, 117.32, 117.27, 117.35, 229/117.34, 131.1, 117.05; 220/495.03, 220/62.21, 723
See application file for complete search history.

(56) References Cited

U.S. PATENT DOCUMENTS 875,780 A 1/1908 Coats
931,808 A 8/1909 Smith
1,120,058 A 12/1914 Hutto
1,132,000 A 3/1915 Dight
1,135,866 A 4/1915 Turner
2,083,776 A 6/1937 Ferguson
(Continued)

FOREIGN PATENT DOCUMENTS

CA 1 159 379 12/1983
CA 2 156 796 2/1997
(Continued)

OTHER PUBLICATIONS

Advertisement, "Designed with Food in Mind, the Unifold Food Grade Intermediate Bulk Container," LB Systemer a/s Uni-Fold, Nordgarde 1A-4520 Svinninge Denmark, 5 pgs. Date unknown.
(Continued)

*Primary Examiner* — Christopher Demeree
(74) *Attorney, Agent, or Firm* — Dorsey & Whitney LLP

(57) ABSTRACT

The present invention provides a flexible liner and bag-in-box container system comprising a collapsible container having a liner attached to the collapsible container, such that when the container is expanded from a collapsed state, the attached liner similarly expands. When the collapsible container is expanded, the liner may expand to substantially conform to the shape of the collapsible container. The liner may further comprise a filler fitting for receiving contents for filling the liner. The filler fitting may comprise one or more annular rings adapted to secure the filler fitting of the liner to an opening in the collapsible container. The collapsible container may be made of corrugated fiberboard. The collapsible container may further include tape having two adhesive sides for securing the collapsible container in an expanded state.

21 Claims, 7 Drawing Sheets

(56) References Cited

U.S. PATENT DOCUMENTS 2,155,057 A 4/1939 Moore
2,260,064 A 10/1941 Stokes
2,333,587 A 11/1943 Salfisberg
2,339,156 A 1/1944 Davis
2,339,665 A 1/1944 Alman
2,352,503 A 6/1944 Walton
2,446,308 A 8/1948 Smith
2,533,554 A 12/1950 Byerly
2,638,263 A 5/1953 Jesnig
2,720,998 A 10/1955 Potter
2,738,796 A 3/1956 Chadwick
2,757,669 A 8/1956 Gewecke et al.
2,799,314 A 7/1957 Dreyer et al.
794,125 A 4/1958 Locke
2,930,423 A 3/1960 Cunningham
2,950,037 A 8/1960 Orsini
2,951,628 A 9/1960 Grussen
2,956,839 A 10/1960 Hermanns
2,973,119 A 2/1961 Parker
3,006,257 A 10/1961 Orsini
3,039,656 A 6/1962 Wentz
3,044,515 A 7/1962 Eades
3,087,491 A 4/1963 Gewecke et al.
3,119,548 A 1/1964 Cooke et al.
3,143,277 A 8/1964 LaFleur
3,208,658 A 9/1965 Membrino
3,224,640 A 12/1965 Schneider
3,244,576 A 4/1966 Swartz
3,253,764 A 5/1966 Goetschius
3,275,197 A 9/1966 Eklund
3,289,386 A 12/1966 Farmer
3,319,684 A 5/1967 Calhoun
3,349,991 A 10/1967 Kessler
3,367,380 A 2/1968 Dickey
3,370,774 A 2/1968 Hopf
3,384,106 A 5/1968 Isbrandtsen
3,386,645 A 6/1968 Powell
3,415,440 A 12/1968 Watters
3,434,652 A 3/1969 Shore
3,447,732 A 6/1969 Jonas
3,462,067 A 8/1969 Shore
3,510,142 A 5/1970 Erke
3,550,662 A 12/1970 Remke et al.
3,559,847 A 2/1971 Goodrich
3,709,426 A 1/1973 Farkas
3,739,977 A 6/1973 Shapiro et al.
3,761,013 A 9/1973 Schuster
3,836,217 A 9/1974 Shiina
3,853,238 A 12/1974 Luisada et al.
3,868,891 A 3/1975 Parish
3,951,284 A 4/1976 Fell et al.
3,965,953 A 6/1976 Becker et al.
3,989,157 A 11/1976 Veenema
3,995,806 A 12/1976 McSherry
4,011,798 A 3/1977 Bambara et al.
4,025,048 A 5/1977 Tibbitts
4,085,244 A 4/1978 Stillman
4,169,548 A 10/1979 Bond
4,174,051 A 11/1979 Edwards
4,177,907 A 12/1979 Funaioli et al.
4,184,527 A 1/1980 Kawamura
4,239,111 A 12/1980 Conant et al.
4,267,960 A 5/1981 Lind et al.
4,270,533 A 6/1981 Andreas
4,309,466 A 1/1982 Stillman
4,362,199 A 12/1982 Futerman
4,421,253 A * 12/1983 Croley ..... 222/105
4,449,646 A 5/1984 Bonerb et al.
4,457,456 A 7/1984 Derby et al.
4,461,402 A 7/1984 Fell et al.
4,476,998 A 10/1984 Bonerb et al.
4,482,074 A 11/1984 Lalley
4,524,459 A 6/1985 Titchenal
4,548,321 A 10/1985 Mockesch et al.
4,549,673 A * 10/1985 Kupersmit ..... 229/117.02
4,560,090 A 12/1985 Okushita
4,561,107 A 12/1985 Herder
4,596,040 A 6/1986 LaFleur et al.
4,597,102 A 6/1986 Nattrass
RE32,232 E 8/1986 Bonerb et al.
4,636,190 A 1/1987 Herder
4,673,112 A 6/1987 Bonerb
4,674,127 A 6/1987 Yamada et al.
4,676,373 A 6/1987 Schneider
4,715,508 A 12/1987 Schurch
4,718,577 A 1/1988 Morris et al.
4,730,942 A 3/1988 Fulcher
4,781,472 A 11/1988 LaFleur et al.
4,783,178 A 11/1988 Herder
4,790,029 A 12/1988 LaFleur et al.
4,796,788 A 1/1989 Bond
4,804,113 A 2/1989 Ciaccio
4,850,506 A * 7/1989 Heaps et al. ..... 229/117.3
4,874,258 A 10/1989 Marino
4,890,772 A * 1/1990 Heuberger et al. ..... 222/156
4,898,301 A 2/1990 Schick
4,917,255 A 4/1990 Foy
4,931,034 A 6/1990 Wagner
4,941,754 A 7/1990 Murdock
4,997,108 A 3/1991 Hata
4,998,990 A 3/1991 Richter et al.
5,002,194 A 3/1991 Nichols
5,020,922 A 6/1991 Schirmer
5,029,734 A 7/1991 Nichols
5,037,002 A * 8/1991 Tschanen ..... 222/105
5,040,693 A 8/1991 Podd et al.
5,054,644 A 10/1991 Greenslade
5,056,667 A 10/1991 Coogan
5,074,460 A 12/1991 Hanekamp
5,096,092 A 3/1992 Devine
5,104,236 A 4/1992 LaFleur
5,120,586 A 6/1992 Nedzu et al.
5,127,893 A 7/1992 LaFleur
5,156,291 A 10/1992 Mielke
5,193,710 A 3/1993 Podd et al.
5,195,661 A 3/1993 Light
5,253,763 A 10/1993 Kirkley et al.
5,269,414 A 12/1993 D'Hollander
5,302,402 A 4/1994 Dudenhoeffer et al.
5,314,086 A 5/1994 Short
5,314,250 A 5/1994 Lee
5,330,069 A 7/1994 Jamison et al.
5,335,820 A 8/1994 Christianson
5,338,117 A 8/1994 Kucksdorf et al.
5,344,048 A 9/1994 Bonerb
5,344,065 A 9/1994 Moran
5,350,239 A 9/1994 Strand et al.
5,368,395 A 11/1994 Crimmins
5,400,916 A 3/1995 Weber
5,427,306 A 6/1995 Petriekis et al.
5,487,470 A 1/1996 Pharo
5,489,037 A 2/1996 Stopper
5,492,270 A 2/1996 Avery et al.
5,494,394 A 2/1996 Podd et al.
5,499,743 A 3/1996 Blumenkron
5,531,361 A 7/1996 Podd
5,547,284 A 8/1996 Imer
5,549,944 A 8/1996 Abate
5,588,549 A 12/1996 Furtner
5,618,254 A 4/1997 Derby
5,636,764 A 6/1997 Bonerb
5,660,299 A 8/1997 Harvey
5,692,546 A 12/1997 Podd et al.
5,711,444 A 1/1998 Meacham et al.
5,765,723 A 6/1998 Wilcox
5,775,541 A 7/1998 Perkins
5,788,121 A 8/1998 Sasaki et al.
5,799,818 A 9/1998 Ringer
5,851,072 A 12/1998 LaFleur
5,865,541 A 2/1999 LaFleur
5,915,596 A 6/1999 Credle, Jr.
5,918,984 A 7/1999 Lafleur et al.
5,941,421 A 8/1999 Overman et al.
5,984,850 A 11/1999 Derby

(56) References Cited

U.S. PATENT DOCUMENTS

| | | | | |
|---|---|---|---|---|
| 5,988,422 | A | 11/1999 | Vallot | |
| 6,120,181 | A | 9/2000 | Wilcox | |
| 6,139,482 | A | 10/2000 | LaFleur | |
| 6,193,416 | B1 | 2/2001 | Kawamata et al. | |
| 6,234,351 | B1 | 5/2001 | Wilcox | |
| 6,332,711 | B1 | 12/2001 | Inuzuka et al. | |
| 6,371,646 | B1 | 4/2002 | LaFleur | |
| 6,374,579 | B1 | 4/2002 | Muller | |
| 6,378,733 | B1 | 4/2002 | Boonzaier | |
| 6,427,873 | B2 | 8/2002 | Wilcox | |
| 6,443,617 | B2 | 9/2002 | Tetenborg | |
| 6,467,652 | B2 | 10/2002 | Wilcox et al. | |
| 6,527,445 | B2 | 3/2003 | LaFleur et al. | |
| 6,533,122 | B1 | 3/2003 | Plunkett | |
| 6,536,687 | B1 | 3/2003 | Navis et al. | |
| 6,588,681 | B2 | 7/2003 | Rothrum et al. | |
| 6,595,441 | B2 | 7/2003 | Petrie et al. | |
| 6,607,097 | B2 | 8/2003 | Savage et al. | |
| 6,637,646 | B1 * | 10/2003 | Muise et al. | 229/117.01 |
| 6,644,510 | B2 | 11/2003 | Kowalics et al. | |
| 6,663,018 | B2 | 12/2003 | Rothrum et al. | |
| 6,752,179 | B1 | 6/2004 | Schwartz | |
| 6,877,654 | B2 * | 4/2005 | Bartlett et al. | 229/125.15 |
| 6,883,683 | B1 | 4/2005 | Cunningham et al. | |
| 7,077,309 | B2 | 7/2006 | Andrews | |
| 7,244,064 | B2 | 7/2007 | Sullivan, Jr. | |
| 7,334,702 | B2 | 2/2008 | Cunningham et al. | |
| 2002/0071922 | A1 | 6/2002 | Bailey | |
| 2002/0148857 | A1 | 10/2002 | Savage et al. | |
| 2002/0164089 | A1 | 11/2002 | LaFleur et al. | |
| 2003/0235349 | A1 | 12/2003 | Ricahrdson, Jr. et al. | |
| 2004/0118741 | A1 | 6/2004 | Sullivan, Jr. | |
| 2005/0017011 | A1 * | 1/2005 | Andrews | 220/495.06 |
| 2005/0078890 | A1 | 4/2005 | Abe et al. | |
| 2005/0100252 | A1 | 5/2005 | Rivlin et al. | |
| 2005/0220369 | A1 | 10/2005 | Sullivan, Jr. | |
| 2005/0220639 | A1 | 10/2005 | Sasaki et al. | |
| 2006/0023973 | A1 | 2/2006 | Plunkett et al. | |
| 2007/0076988 | A1 | 4/2007 | Sullivan et al. | |
| 2007/0201774 | A1 | 8/2007 | Plunkett et al. | |
| 2007/0237433 | A1 * | 10/2007 | Plunkett et al. | 383/105 |

FOREIGN PATENT DOCUMENTS

| | | |
|---|---|---|
| DE | 60 598 | 11/1890 |
| DE | 1 486 433 | 4/1969 |
| DE | G 89 06 059.8 | 11/1989 |
| EP | 0 098 322 | 1/1984 |
| EP | 0 362 102 | 4/1990 |
| EP | 0 276 994 | 12/1992 |
| EP | 1 277 666 | 1/2003 |
| EP | 1 435 265 | 7/2004 |
| EP | 1 415 719 | 5/2009 |
| FR | 1 331 060 | 6/1963 |
| FR | 2 316 151 | 3/1977 |
| FR | 2 375 113 | 8/1978 |
| FR | 2 742 129 | 6/1997 |
| GB | 1 591 323 | 6/1981 |
| GB | 2 194 512 | 3/1988 |
| GB | 2 245 883 | 1/1992 |
| GB | 2 268 231 | 1/1994 |
| GB | 2 323 846 | 10/1998 |
| GB | 2 356 854 | 6/2001 |
| JP | 64-009174 | 1/1989 |
| JP | 2-139383 | 5/1990 |
| JP | 5-221451 | 8/1993 |
| JP | 6-115557 | 4/1994 |
| JP | 6-122457 | 5/1994 |
| JP | 6-179455 | 6/1994 |
| JP | 6-255657 | 9/1994 |
| JP | 8-104391 | 4/1996 |
| WO | 82/03838 | 11/1982 |
| WO | 89/11422 | 11/1989 |
| WO | 98/32539 | 7/1998 |
| WO | 02/057151 | 7/2002 |
| WO | 02/074226 | 9/2002 |

OTHER PUBLICATIONS

Advertisement, "Stocklin, Collapsible Container, innovative and Environment-Friendly Packaging," Walter Stocklin AG, Forder Und Lagertechnik, CH-4143 Dornach/Schweiz, 4 pgs. Date unknown.

Advertisement, "CFS Developments (Proprietary) Ltd.," Postal Address: P.O. Box 4852 Luipaardsvlei 1743 South Africa, 4 pgs. Date unknown.

Advertisement, "Reusable Container Systems, Industry Leader in quality, innovation and service," Ropak Corporation, Materials Handling Group, A Member of the Linpac Group of Companies, 7 pgs. Date unknown.

Advertisement, "Econobox, A Whole New Dimension, Cost-effective Solutions for Materials Handling," GE Polymer Logistics, 3 pgs. Date unknown.

Advertisement, "Introducing the Arena 330 Shipper, It beats the drum and everything else," GE Silicones, A. R. Arena Products, Inc., 2101 Mt. Read Blvd., Rochester, New York, 1465, 4 pgs. Date unknown.

Advertisement, TNT Container Logistics, Containers for Hazardous Goods, Hazcon & Uni-Fold, 2 pgs. Date unknown.

Author unknown, "TNT: TNT Liquid Discharge Roller Arm," 2 pgs., date unknown.

* cited by examiner

SHOWS BAG WITH BOTTOM SQUARED OUT AND FITTING LOCKED IN PLACE

FLEXIBLE LINER AND BAG-IN-BOX CONTAINER SYSTEMS

CROSS-REFERENCE TO RELATED APPLICATIONS

This application claims priority to U.S. Provisional Application No. 60/909,759 filed on Apr. 3, 2007, the contents of which are incorporated in its entirety herein by reference.

FIELD OF THE INVENTION

The present invention relates to flexible liners for use in containers such as those used in flexible intermediate bulk container ("FIBC") systems or bag-in-box container systems. More particularly, the present invention relates to systems and methods for a flexible liner and collapsible bag-in-box container system.

BACKGROUND OF THE INVENTION

In recent years a number of industries have adopted the FIBC or bag-in-box concepts for storing and transporting liquid and particulate commodities in relatively large quantities. For example, the bag-in-box concept has been employed for transporting in bulk such diverse products as beverages, vegetable oils, salad dressings, syrups, soy sauce, peanut butter, pharmaceuticals, talc, motor oil, industrial chemicals, detergents in liquid or powder form, and toiletry products or ingredients, etc.

The FIBC concept includes a bulk container system comprising a flexible liner in a flexible or semi-flexible bag. In one embodiment, a FIBC bag is made of a woven material (e.g., woven polymer, TYVEX®, canvas, wire mesh or net). The flexible liner is typically chemically resistant and impermeable to water and air and serves as the container for a selected commodity. The FIBC bag serves as a protective container for the flexible liner and its contents. A FIBC bag is disclosed in U.S. Pat. No. 4,596,040 to LaFleur et al., which issued Jun. 17, 1986, and is hereby incorporated by reference in its entirety.

The bag-in-box concept comprises a flexible or foldable liner and a rigid or semi-rigid box as an outer container. The flexible liner is generally prepared by seal working plastic films or an integrated molding manufactured by blow-molding fused plastic into an integrated mold, etc. The flexible liner is typically chemically resistant and impermeable to water and air and serves as the container for a selected commodity. The box may be made of plywood or other materials, cardboard, fiberboard, metal, or plastic. The box serves as a protective container for the flexible liner and its contents. A box for a bag-in-box system is disclosed in U.S. Pat. No. 6,533,122 to Plunkett, which issued Mar. 18, 2003, and is hereby incorporated by reference in its entirety. A bag for use in a bag-in-box system is disclosed in US 2005-0220369 A1, entitled "Bag With Flap for Bag-In-Box Container Systems," which is hereby incorporated by reference in its entirety.

In one embodiment, the liner may include at least a filler fitting near the top of the liner whereby the liner may be filled with, or drained of, its contents. The outer container usually comprises a cover or top panel that is removable to permit access to the liner and the filler fitting.

A financial consideration of the bag-in-box mode of shipment of materials in bulk is that the outer container can be a non-returnable or one-way container. For example, where the outer container is a box for a bag-in-box system and is generally made of a corrugated fiberboard or the like, the box can be discarded after use.

With respect to the bag-in-box concept as applied to bulk shipment or commodities, the plastic flexible liners have taken various forms. One common form is the so-called "pillow" type, which consists of at least two sheets of plastic film sealed together at their edges. Another common form is the six-sided flexible liners (e.g., liners that take the shape of a cube or rectangular parallelepiped when filled) made from a plurality of sheets of plastic film.

Regardless of the type of liner in the outer container, it can be difficult to completely fill or empty the liner. This is especially the case when the content of the liner is a viscous liquid. During the discharge of the liner's contents, the evacuated portion of the liner has a tendency to collapse due to a vacuum effect. Similarly, when the liner is being filled, the liner again tends to collapse because the contents pull the sides of the liner downward. In either case, as the liner collapses, folds are created that entrap the contents of the liner.

The flexible liner is often inferior at conforming to an interior shape of the outer container. Thus, when the flexible liner is positioned within the outer container, there is wasted or dead space between the flexible liner and the outer container. When dead space is formed between the flexible liner and the outer container, the flexible liner moves easily within the outer container, which may lead to breakage of the flexible liner during shipping. Similarly, when the flexible liner does not conform to the interior shape of the outer container, undesired folds or bends can occur in the flexible liner. When a part of the flexible liner is folded or bent in an undesired location, the contents will remain in the folded or bent portions, such that it is difficult to completely empty the contents from the flexible liner.

Furthermore, flexible liners are often not self-supporting. It can be difficult and inconvenient to handle the flexible liners at the same time the flexible liner is being filled or emptied.

Therefore, there is a need for a system and method of supporting a liner off an outer container used in a bag-in-box system, thereby decreasing the tendency of the liner to collapse, or fold over on itself, during filling or emptying of the liner contents. There is a further need for a system and method providing the ability to fill a liner of a bag-in-box system to capacity. There is also a need for a system and method of combining or incorporating the liner with an outer container used in a bag-in-box system. There is a need for a system and method for a collapsible liner and collapsible bag-in-box outer container.

BRIEF SUMMARY OF THE INVENTION

The present invention, in one embodiment, is a collapsible container having a liner attached to the collapsible container, such that when the container is expanded from a collapsed state, the attached liner similarly expands. The liner may be impermeable to water and air. The liner may be securely attached to the collapsible container with glue. When the collapsible container is expanded, the liner may expand to substantially conform to the shape of the collapsible container. In some embodiments, the liner is substantially rectangular when the collapsible container is expanded.

The liner may further comprise a filler fitting for receiving contents for filling the liner. The filler fitting may comprise one or more annular rings adapted to secure the filler fitting of the liner to an opening in the collapsible container.

The collapsible container, in some embodiments, may be made of corrugated fiberboard, or cardboard. The collapsible container may further include tape having two adhesive sides for securing the collapsible container in an expanded state. In a further embodiment, the double-sided tape may secure two overlapping portions of the collapsible container.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the present invention, it is believed that the invention will be better understood from the following description taken in conjunction with the accompanying Figures, in which:

DETAILED DESCRIPTION

The present invention is a novel and advantageous flexible liner and collapsible bag-in-box container system. While the description set forth below may refer to a liner, it is to be recognized that the liner may be a liner or an FIBC. Generally, the present invention may have a flexible liner that is attached to a bag-in-box container. The flexible liner and the bag-in-box container may be stored, shipped, etc. together in a collapsed, or folded, state. When the bag-in-box container is expanded, the flexible liner may expand correspondingly.

Figure 1:
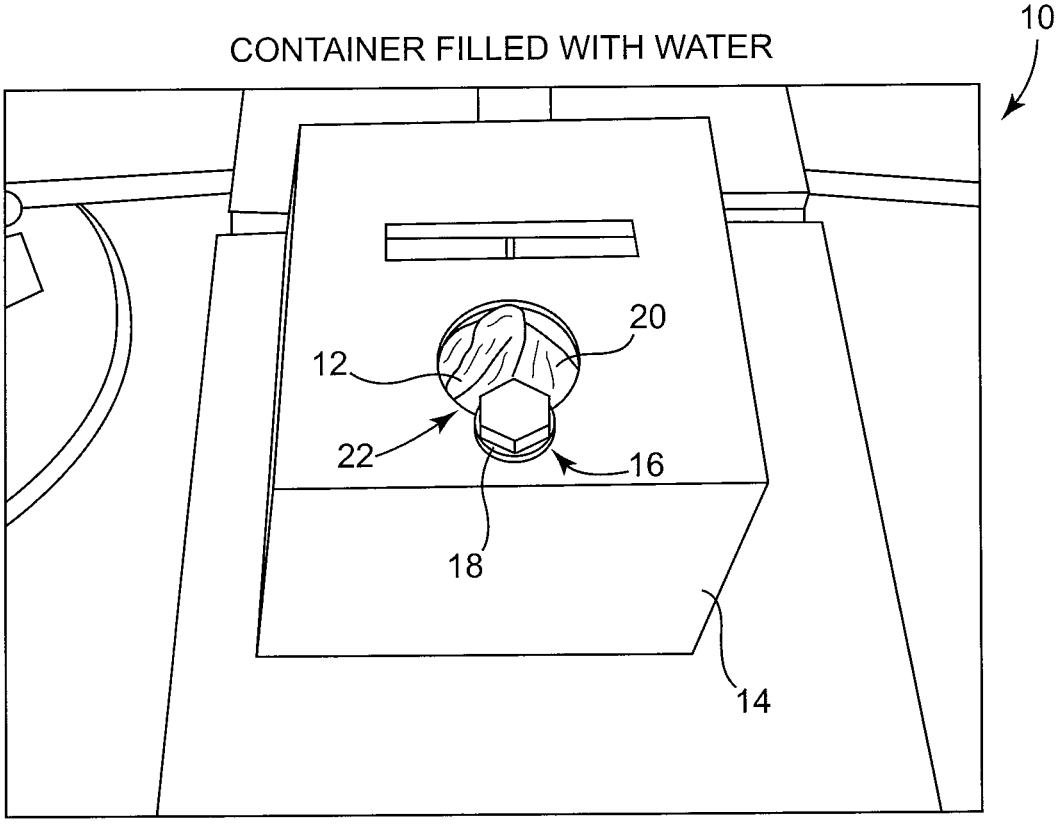
FIG. 1 is a top perspective view of a liner and collapsible bag-in-box container as shown in a fully expanded state in accordance with an embodiment of the present invention.

FIG. 1 illustrates one embodiment of a flexible liner and collapsible bag-in-box container system 10 of the present invention in an expanded and filled state. The system 10 may include a flexible liner 12 and a bag-in-box container 14. When expanded, the bag-in-box container 14 may form the shape of a rectangle, cube, or any other suitable shape for carrying a flexible liner 12 for transporting liquid and particulate commodities, such as those previously described.

The flexible liner 12 may comprise of a flexible, heat-sealable packaging material in sheet form. For example, the packaging material may consist of polyethylene, polypropylene, or some other thermoplastic material, or be a laminate of two or more packaging materials bonded to one another. Each of the portions of the flexible liner 12 may comprise a single sheet of packaging material (i.e., single ply) or two or more sheets of packaging material (i.e., multi-ply). Where more than a single sheet of packaging material is used, the individual sheets may be of like or different material and may be secured to one another only at selected areas. Certain embodiments of flexible liners or bags for bag-in-box systems are disclosed in U.S. Pat. No. 5,788,121 to Sasaki et al., which issued Jun. 17, 1986, and US 2006-0023973 A1, entitled "Flexible Liner for FIBC or Bag-In-Box Container Systems," which are each hereby incorporated by reference in their entirety.

The flexible liner 12 may include a filler fitting 16 through which the flexible liner 12 may be filled or emptied. The filler fitting may further comprise a cap 18, which may preferably be liquid-tight, for sealing the filler fitting 16. The filler fitting 16 may be located at a top, or upper, portion of the flexible liner 12, such that it may be accessed through a top portion of the bag-in-box container 14.

A typical example of the bag-in-box container 14 may be comprised of corrugated fiberboard or like material. In other embodiments, the bag-in-box container 14 may be comprised of plywood, metal, plastic, or any other suitable material or combination thereof. In one embodiment, a wall surface of the bag-in-box container may contain a filler opening 20 for accessing the filler fitting 16 of the flexible liner 12. Filler opening 20 may be any shape suitable for providing access to the flexible liner 12. In one embodiment, filler opening 20 may generally be in the shape of a circle. In a further embodiment, the filler opening 20 may comprise a slot, recess, indent, hole, or other suitable means 22 for positioning the filler fitting 16 of the flexible liner 12 in a temporary, locked position, as illustrated in FIG. 1. In such an embodiment, the filler fitting 16 may comprise one or more protrusions or annular rings extending outward from the filler fitting for securing the filler fitting 16 in the filler opening slot 22. In the locked position, the filler fitting 16 may be easier to handle while filling the flexible liner 12 than would be without a means for securing the filler fitting 16 to the bag-in-box container 14 while filling.

Figure 2:
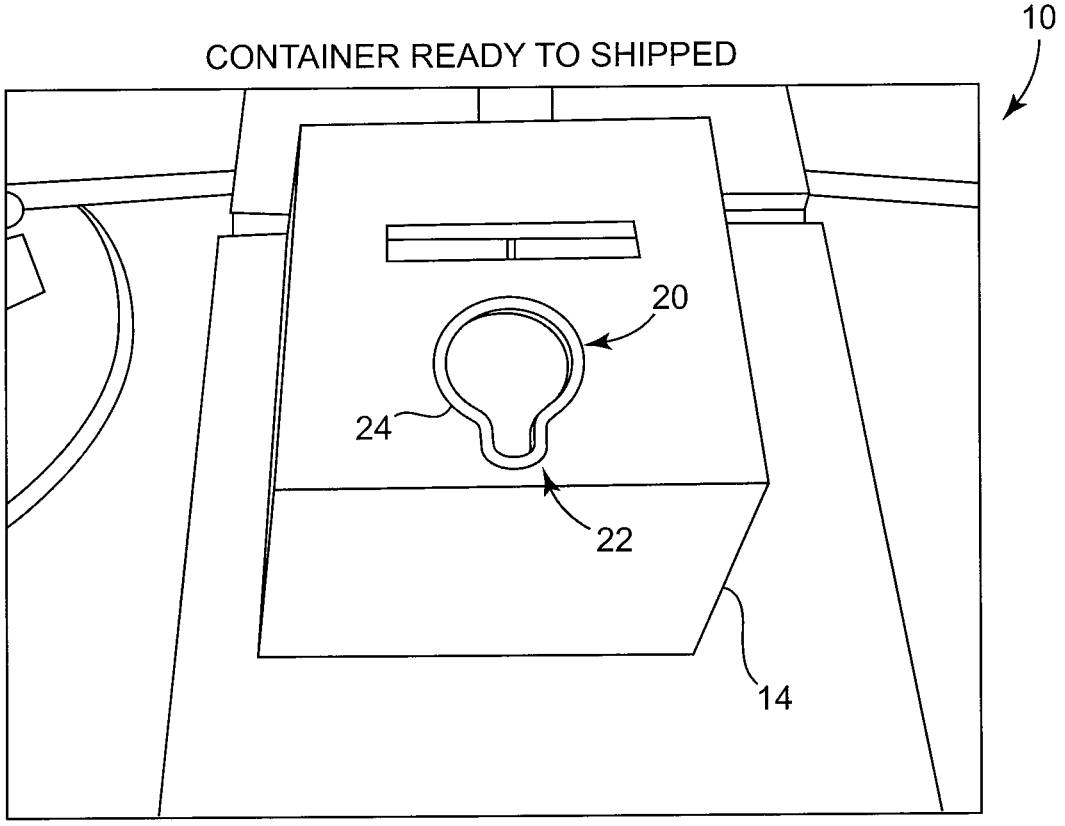
FIG. 2 is a top perspective view of a collapsible bag-in-box container of the embodiment shown in FIG. 1 with a cover or cap attached to the bag-in-box container.

FIG. 2 illustrates an embodiment of a flexible liner and collapsible bag-in-box container system 10 in an expanded and filled state and ready for shipping. In such a state, the filler fitting 16 may be removed from the filler opening slot 22 and moved to a position entirely within the bag-in-box container 14. In one embodiment, the bag-in-box container 14 may include a removable cover 24 for the filler opening 20. In one embodiment, the removable cover 24 is made of plastic or suitable material. In other embodiments, the removable cover 24 is made of metal, fiberboard or like material, fabric, paper, or any other suitable material or combination of materials. In a further embodiment, the removable cover 24 is shaped and adapted to fit within filler opening 20 and filler opening slot 22. In other embodiments, the removable cover 24 is adapted to fit over the filler opening 20, such that the removable cover 24 partially or entirely covers the filler opening 20 and filler opening slot 22.

In one embodiment, the dimensions or sizes of the collapsible bag-in-box container may be determined in consideration of the International Standard of a pallet. In a further embodiment, the collapsible bag-in-box container 14 may have any desired length, width, and height. For example, a length of from about 8 to 15 inches or from about 10 to 13 inches, a width of from about 8 to 15 inches or from about 10 to 13 inches, and a height from about 7 to 13 inches or from about 9 to 11 inches may be used. In some embodiments, the bag-in-box container 14 may be rectangular-shaped. In a further embodiment, the bag-in-box container 14 may be cube-shaped. In yet other embodiments, the shape and dimensions or sizes of the collapsible bag-in-box container 14 may be pillow-shaped, or any other suitable shape or size. In some embodiments, the collapsible bag-in-box container 14 may be dimensioned and/or shaped to hold a flexible liner 12 designed to hold from about 1 to 5 gallons of contents therein.

Figure 3:
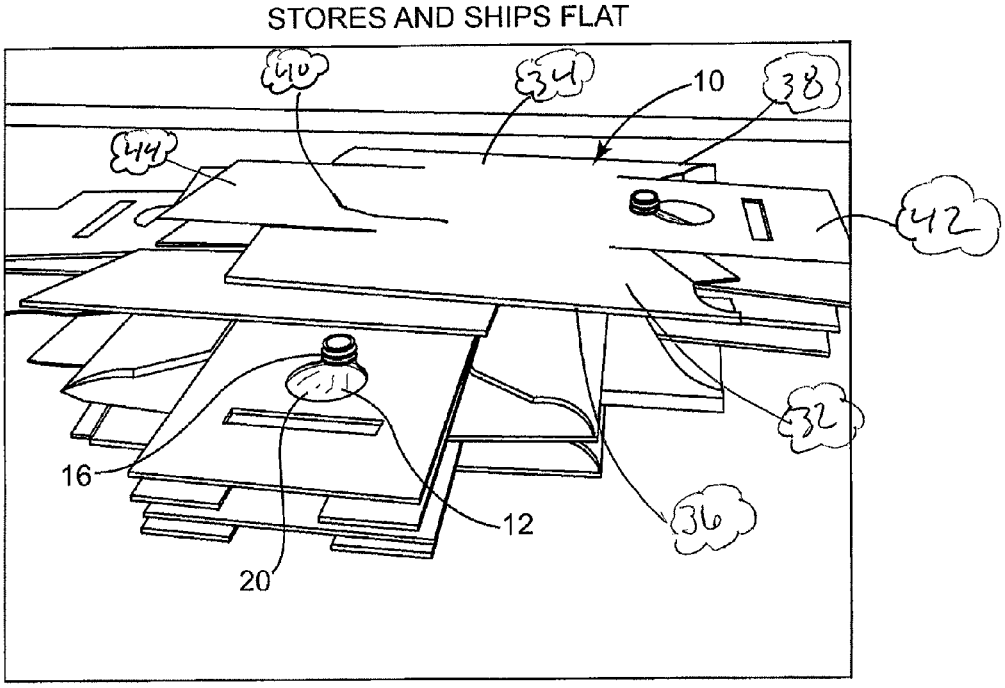
FIG. 3 is a perspective view of a collapsed liner and bag-in-box container of the embodiment shown in FIG. 1.

FIG. 3 illustrates an embodiment of a flexible liner and collapsible bag-in-box container system 10 in a collapsed or folded state. FIG. 3 shows a fold 36 generally bisecting side wall 32 and a fold 38 generally bisecting side wall 34, so the side walls 32 and 34 are folded upon themselves and the walls 40, extending between the sidewalls 32, 34 and end walls 42, 44 lie generally flat and aligned over each other. In a collapsed state, the flexible liner and collapsible bag-in-box container system 10 may be easy to store, ship, etc.

Figure 4:
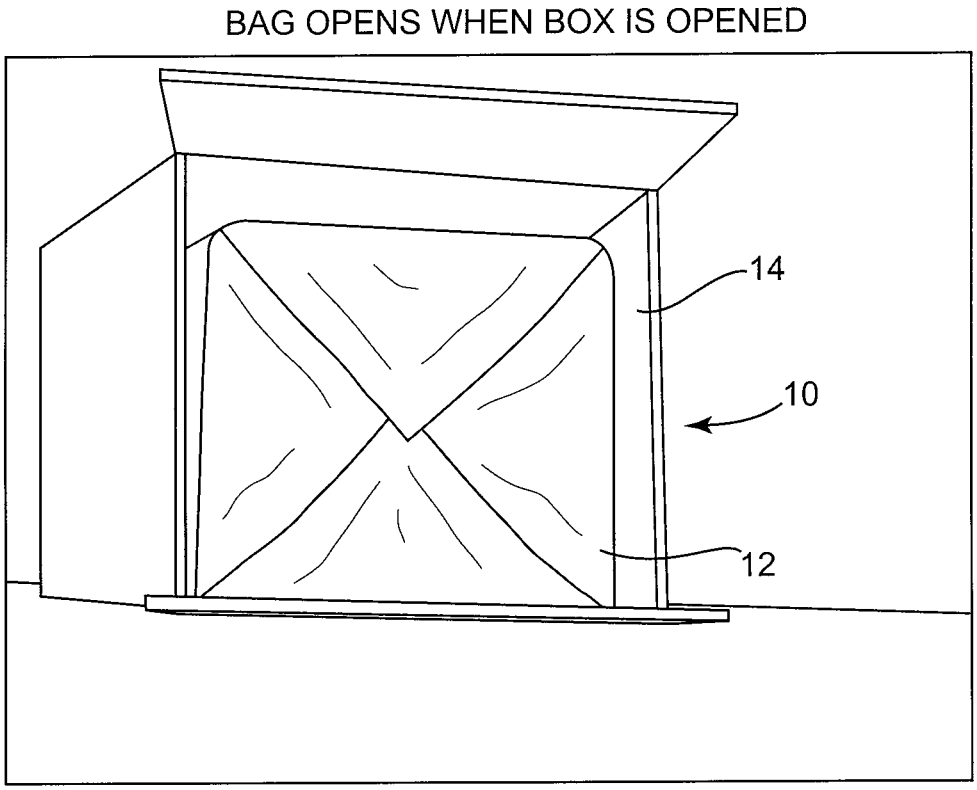
FIG. 4 is a bottom view of a liner and collapsible bag-in-box container of the embodiment shown in FIG. 1 in an expanded state.

FIG. 4 illustrates a bottom view of an embodiment of a flexible liner and collapsible bag-in-box container system 10 in an expanded state with the bottom flaps of the bag-in-box container 14 open. As can be seen from FIG. 4, as the bag-in-box container 14 is expanded, the flexible liner 12 may expand with the bag-in-box. Thus, the flexible liner 12 may substantially conform to the shape of the expanded bag-in-box container 14. The flexible liner 12 may be attached to the bag-in-box container 14 using any suitable method for securely attaching the flexible liner 12 to the bag-in-box container 14, such as by gluing, taping, tying, mechanically securing, notching, etc. In one embodiment, the flexible liner 12 may be glued to the bag-in-box container 14. In further embodiments, the flexible liner 12 may be glued to the bag-in-box container 14 only at selected areas. For example, in one embodiment, the sides of the flexible liner 12 may be securely attached, or glued, to the sides of the bag-in-box container 14, leaving top and bottom flaps of the bag-in-box container 14 free to move in positions away from the flexible liner 12, such as when the flexible liner and collapsible bag-in-box container system 10 is in a collapsed or folded state. In yet other embodiments, the corners of the flexible liner 12 may be securely attached, or glued, to the corners of the bag-in-box container 14. In any case, the flexible liner 12 may be securely attached to the bag-in-box container 14 in a manner that allows the flexible liner and collapsible bag-in-box container system 10 to be easily positioned in a collapsed or folded state.

Figure 5:
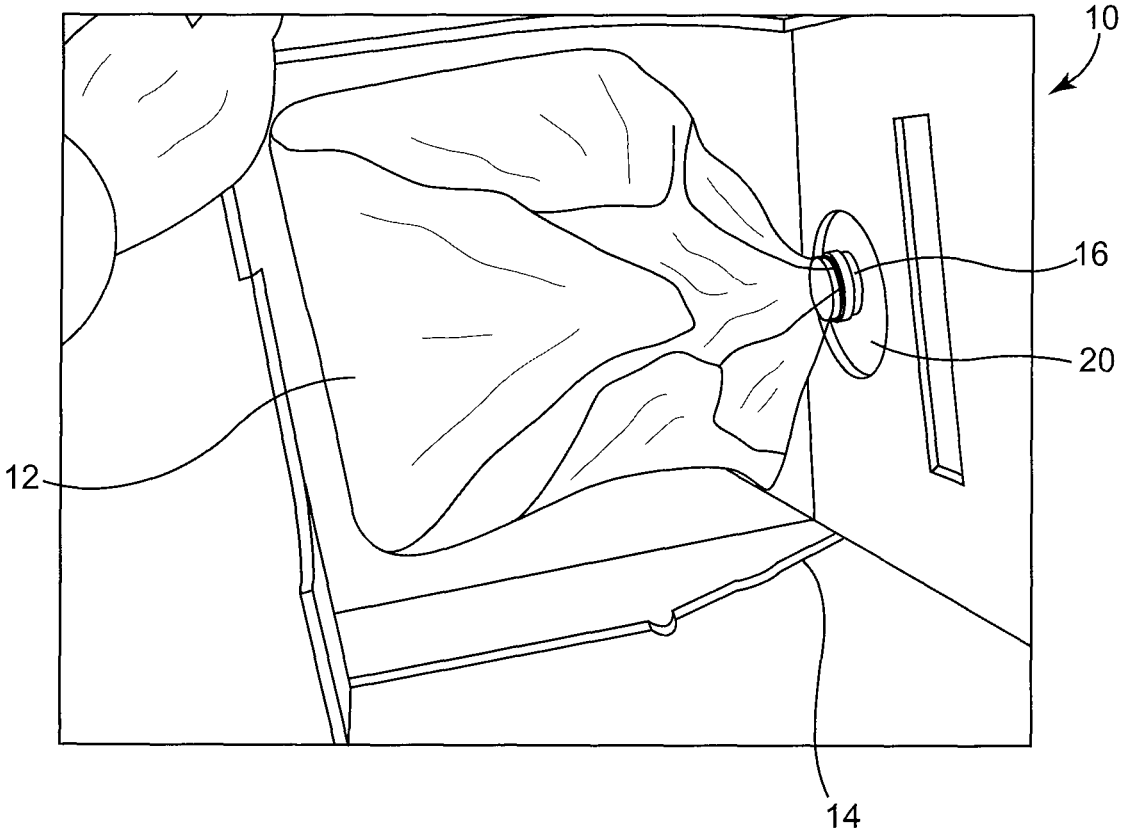
FIG. 5 is top view of a liner and collapsible bag-in-box container of the embodiment shown in FIG. 1 with the bottom of the bag-in-box container squared out and with the filler fitting of the liner positioned in the filler opening of the bag-in-box container.

FIG. 5 illustrates a top view of one embodiment of a flexible liner and collapsible bag-in-box container system 10, wherein the flexible liner 12 is expanded to conform to the shape of the bag-in-box container 14. As can be seen from FIG. 5, not all portions of the flexible liner 12 need be securely attached to the bag-in-box container 14. In some embodiments, the flexible liner 12 is not securely attached to the bag-in-box container 14 at, or near, the top portion(s) of the flexible liner 12, such that the filler fitting 16 may be freely moved throughout a range of motion that allows easy handling, filling, etc. of the flexible liner 12.

Figure 6:
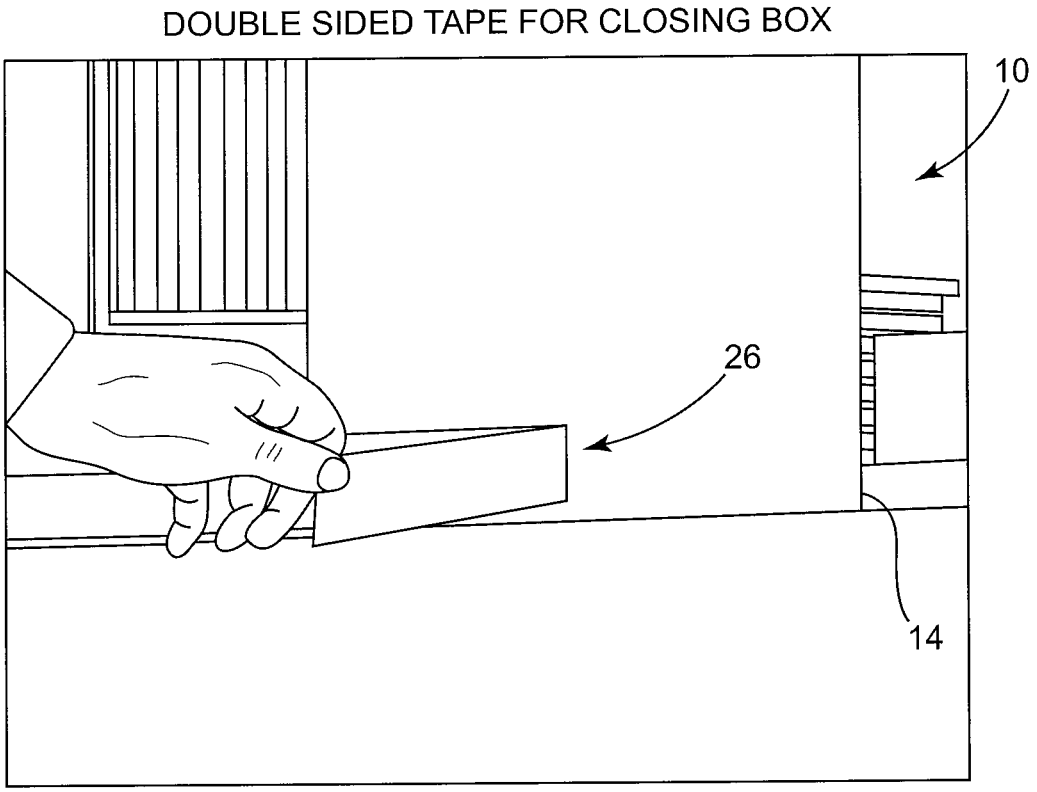
FIG. 6 is a side view of a collapsible bag-in-box container of the embodiment shown in FIG. 1 having double-sided tape for securing the bag-in-box container in an expanded position.
Figure 7:
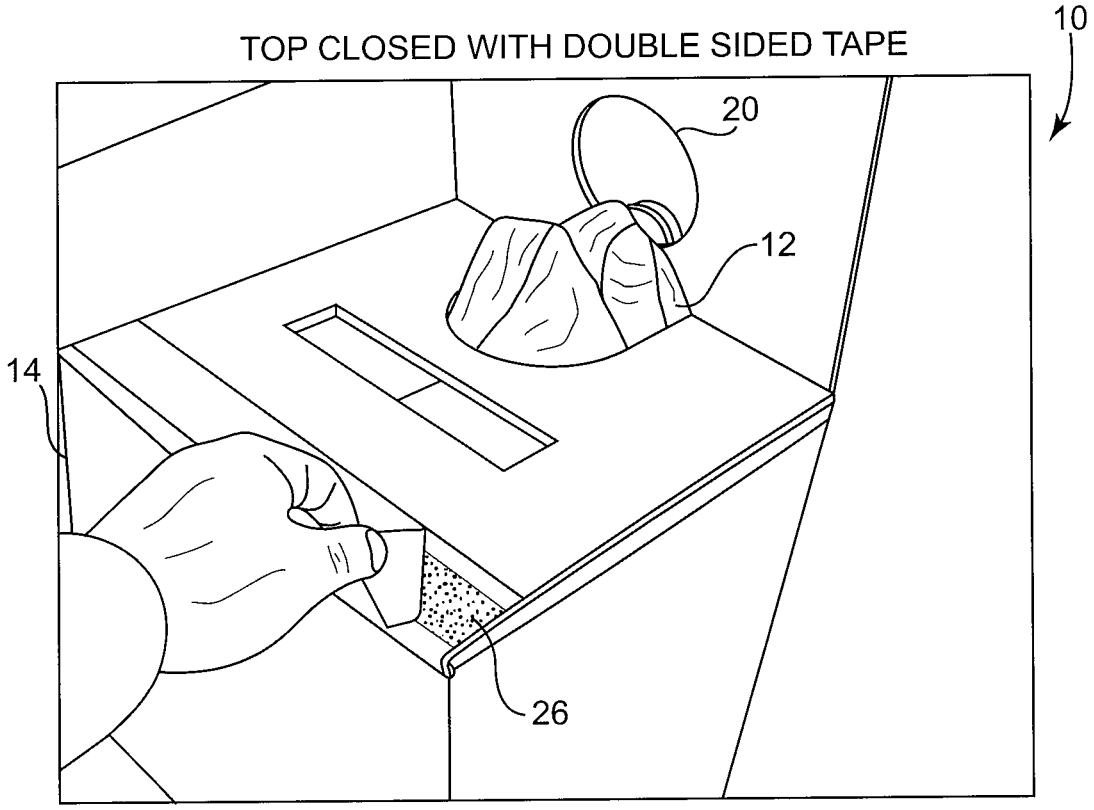
FIG. 7 is a top perspective view of a liner and collapsible bag-in-box container of the embodiment shown in FIG. 1 having double-sided tape for securing the top of the bag-in-box container in a closed position.

As can be seen from FIGS. 6 and 7, a bag-in-box container 14 for a flexible liner and collapsible bag-in-box container system 10 of the present invention may further include means for securely closing the bag-in-box container 14 or otherwise securing the bag-in-box container 14 in an expanded state. In one embodiment, the means for closing or securing the bag-in-box container 14 in an expanded state includes double-sided tape 26. The double-sided tape 26 may be located at any suitable location for securing two or more portions of the bag-in-box container 14 together. In other embodiments, the means for closing or securing the bag-in-box container 14 in an expanded state may include any suitable means now known or hereafter created for closing or securing the bag-in-box container in an expanded, ready-for-shipping state as illustrated in FIGS. 1 and 2. For example, the means for closing or securing may include, gluing, tacking, notching, etc. As can be seen in FIG. 7, double-sided tape 26 may be used for securing two top portions of a bag-in-box container 14 together, thereby enclosing the flexible liner 12 in the bag-in-box container 14. As previously mentioned, any suitable means may be used for securing two top portions of a bag-in-box container 14 together.

Although the present invention has been described with reference to preferred embodiments, persons skilled in the art will recognize that changes may be made in form and detail without departing from the spirit and scope of the invention.

We claim:

1. A liner and container system comprising:

a collapsible container having first and second walls opposed to each other, and a first side wall and a second side wall opposed to the first side wall, wherein the first and second sidewalls are located between the first and second walls, the collapsible container being configurable between:

a collapsed state in which the first side wall is folded upon itself along a first fold and the second side wall is folded upon itself along a second fold wherein the first side wall and the second side wall are folded away from each other at the folds allowing the first wall to lay substantially flat and substantially align with the second wall; and an expanded state in which the first and second walls are erected and the first and second side walls are unfolded and generally parallel to one another; and a liner comprising a liquid-tight enclosure that is attached to sides of the collapsible container, so that expansion of the container from the collapsed state to the expanded state causes the liner to expand with the container.

2. The liner and container system of claim 1, wherein the liner comprises a filler fitting that receives contents for filling the liner.

3. The liner and container system of claim 2, wherein the container comprises a first end wall that defines a filler opening for receiving the filler fitting of the liner.

4. The liner and container system of claim 3, further comprising a removable cover component adapted to fit in the filler opening and positioned therein when the filler fitting is removed therefrom.

5. The liner and container system of claim 4, wherein the liner is securely attached to the container while allowing the filler fitting to be removable from the filler opening in the expanded state such that in response to the liner being filled, the filler fitting may be removed from the filler opening and the filler opening may be closed with the removable cover.

6. The liner and container system of claim 3, wherein the filler opening comprises a larger portion and a smaller portion with a slot defining the smaller portion and extending from the larger portion.

7. The liner and container system of claim 6, wherein the filler fitting comprises an annular ring extending outwardly from the filler fitting for securing the filler fitting in the slot while allowing the filler fitting to be removable from the slot and pushed through the larger portion into the collapsible container.

8. The liner and container system of claim 1, further comprising at least one attachment feature adapted to facilitate the closure of the collapsible container in an expanded state.

9. The liner and container system of claim 8, wherein the at least one attachment feature is a piece of tape affixed to a first portion of two overlapping portions of the collapsible container.

10. The liner and container system of claim 9, wherein the tape comprises two adhesive sides and facilitates the attachment of a second portion of the two overlapping portions of the collapsible container to the first portion.

11. The liner and container system of claim 1, wherein the liner is impermeable to water and air.

12. The liner and container system of claim 1, wherein the container is made of a corrugated fiberboard.

13. The liner and container system of claim 1, wherein the liner comprises a plurality of heat sealed side portions that are folded inwardly on themselves to form gussets.

14. A collapsible container system comprising:

a collapsible container having a first wall and a second wall opposed to the first wall, and at least a first side portion located between the first and second walls and, the collapsible container being configurable between:

a collapsed state in which the first side portion is folded generally down the middle such that the first side portion is folded upon itself and the first wall substantially aligns with the second wall wherein the first side portion folds away from a second opposing side portion; and an expanded state in which the first wall, second wall, and first side portion are erected; and a liner comprising a liquid-tight enclosure formed of plurality of heat sealed liner side portions that are folded inwardly on themselves, in a collapsed state, to form gussets, wherein the liner is securely affixed to the walls of the collapsible container such that in response to the container being expanded from the collapsed state, the attached liner similarly expands, wherein the liner includes a filler fitting that passes through and is removably attached to an end wall by being positioned in an opening which includes a slot portion, wherein the filler fitting is removably attached to the end wall in the expanded state.

15. The collapsible container of claim 14, further comprising a side portion opposed the first side portion and located between the first and second walls, wherein:

when the collapsible container is in the collapsed state, the second side portion is folded generally down the middle such that the second side portion is folded upon itself and the first wall substantially aligns with the second wall.

16. The collapsible container of claim 15, wherein the first side portion and the second side portion are configured substantially parallel to one another when the container is in an expanded state.

17. The collapsible container of claim 15, wherein the first side portion and the second wall are configured substantially perpendicular to one another when the container is in an expanded state.

18. A container system comprising:

a collapsible container having a plurality of walls that are expandable between a collapsed state and an expanded state, the plurality of walls including first and second walls opposed to each other, a first end wall with an opening providing access to the interior of the collapsible container, and a second side wall opposed to the first side wall, wherein the first and second sidewalls are located between the first and second walls, wherein, in the collapsed state, the first side wall is folded upon itself along a first fold and the second side wall is folded upon itself along a second fold, and the first side wall and the second side wall are folded away from each other at the folds allowing the first wall to lay substantially flat and substantially align with the second wall; and a liner comprising a liquid-tight enclosure formed by a plurality of walls and a filler fitting extending from one of the walls, the liner comprising a plurality of heat sealed side portions that are folded inwardly on themselves to form gussets, the liner being attached to sides of the collapsible container so that expansion of the container from the collapsed state to the expanded state causes the liner to expand within the container, wherein the filler fitting is securable in the opening in the expanded state such that, in the expanded state, the filler fitting is removable from the opening and placed in a position entirely within the collapsible container.

19. The container system of claim 18, wherein the opening comprising larger portion and smaller portion with a slot extending therefrom defining the smaller portion.

20. The container system of claim 19, wherein the filler fitting comprises an annular ring extending outwardly from the filler fitting for securing the filler fitting in the slot while allowing the filler fitting to be removable from the slot and pushed through the larger portion into the collapsible container.

21. The container system of claim 20, comprising a removable cover component shaped to fit the opening and positioned therein when the filler fitting is removed therefrom.

* * * * *